US005639145A

United States Patent [19]

Alderman

[11] Patent Number: 5,639,145

[45] Date of Patent: Jun. 17, 1997

[54] PORTABLE CUSHION

[76] Inventor: Willis H. Alderman, 10905 W. 32nd Ave., Wheat Ridge, Colo. 80033

[21] Appl. No.: 527,174

[22] Filed: Sep. 11, 1995

[51] Int. Cl.[6] ..... A47C 27/15

[52] U.S. Cl. ..... 297/452.45; 297/229; 297/188.04; 5/653; 5/901

[58] Field of Search ..... 297/219.1, 228.12, 297/229, 452.16, 452.17, 452.45, 188.04; 5/653, 655.9, 901

[56] References Cited

U.S. PATENT DOCUMENTS

| | | | |
|---|---|---|---|
| 2,920,619 | 1/1960 | McMillan et al. . | |
| 3,258,791 | 7/1966 | Kaplan . | |
| 3,346,298 | 10/1967 | Champion | 297/382 X |
| 3,602,548 | 8/1971 | Grams . | |
| 3,841,320 | 10/1974 | Brown, Jr. . | |
| 4,037,591 | 7/1977 | Sarno . | |
| 4,039,363 | 8/1977 | Robertson | 297/DIG. 1 |
| 4,457,032 | 7/1984 | Clarke . | |
| 4,847,933 | 7/1989 | Bedford | 5/653 X |
| 5,163,194 | 11/1992 | Dixon | 5/640 X |
| 5,265,292 | 11/1993 | Underell . | |
| 5,294,181 | 3/1994 | Rose et al. | 5/653 X |
| 5,360,257 | 11/1994 | Seracca | 297/382 X |
| 5,388,295 | 2/1995 | Sarkozi . | |
| 5,403,066 | 4/1995 | Drum | 297/452.16 X |
| 5,433,505 | 7/1995 | Coyne et al. | 5/653 X |

*Primary Examiner*—Peter R. Brown
*Attorney, Agent, or Firm*—Ancel W. Lewis, Jr.

[57] ABSTRACT

A portable, flexible cushion disclosed utilizes layers of different foam plastic materials secured together at contacting faces. The cushion combines closed cell and open cell foam plastic material features and a hinged construction providing reversibility and can be used in right angle and flat end to end applications. Optionally, vibrators are received in openings in the panels for therapeutic purposes. Different combinations of the closed and open cell materials are particularly suitable for wet or dry applications.

24 Claims, 5 Drawing Sheets

Fig. 9
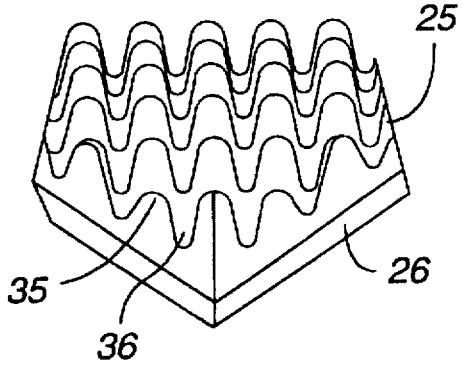
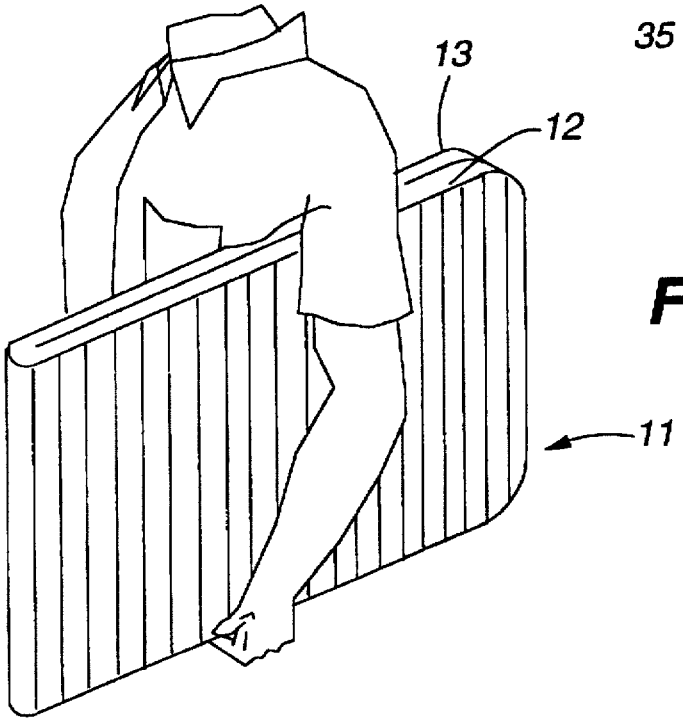
Fig. 10
Fig. 11
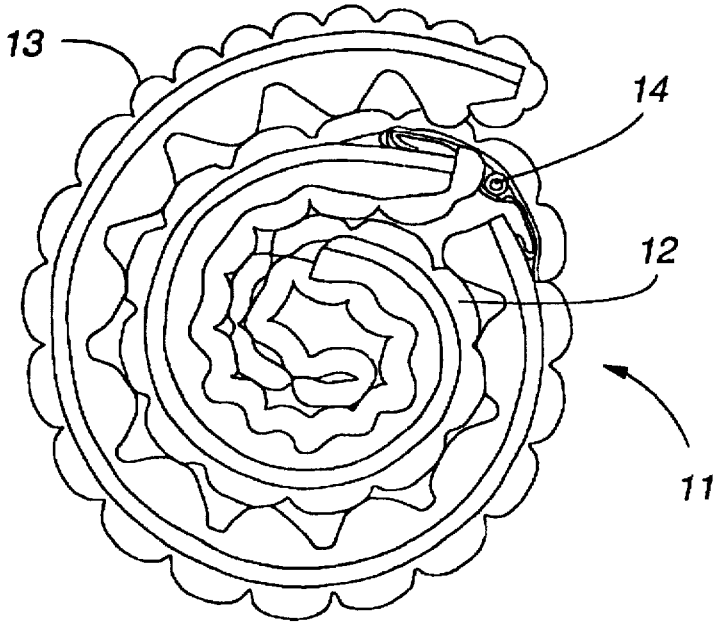

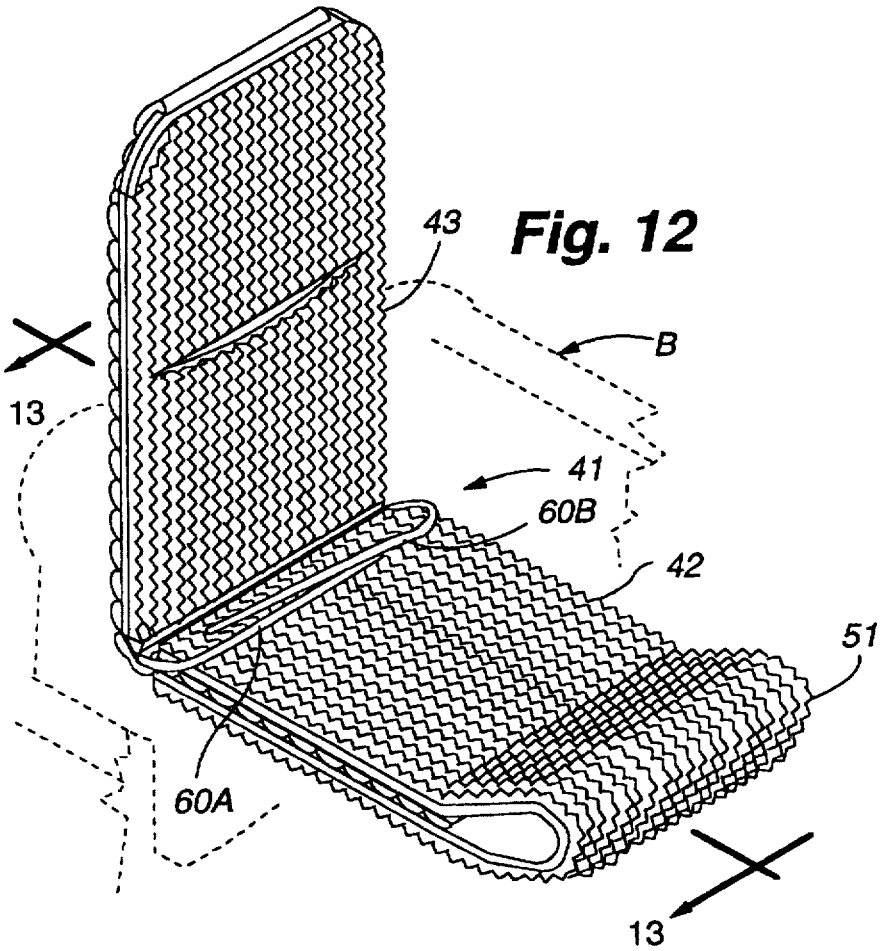
Fig. 12
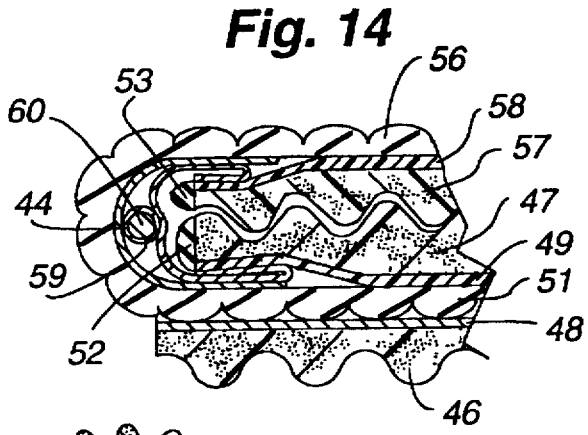
Fig. 14
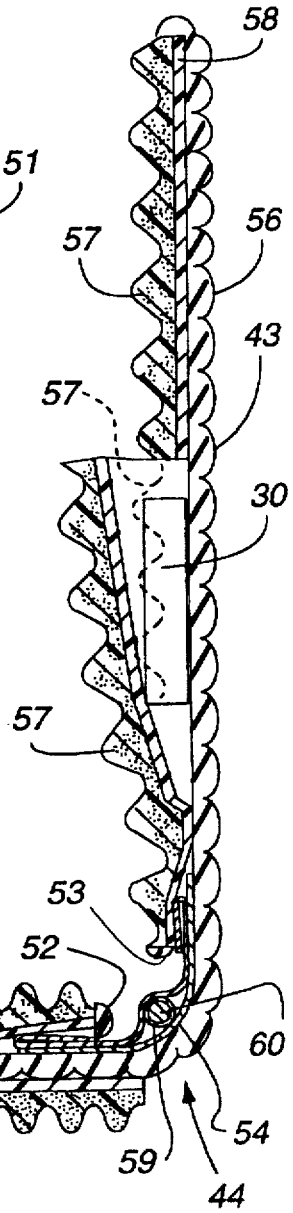
Fig. 13
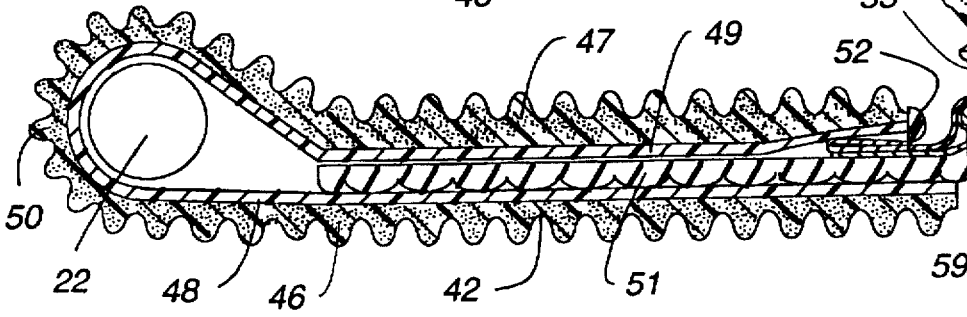

PORTABLE CUSHION

TECHNICAL FIELD

This invention relates to cushions that can provide user comfort on hard surfaces and body stimulation for users and also can be used in wet or dry situations.

BACKGROUND ART

In general, cushion panels made of more than one layer of dissimilar foam plastic materials and hinged panels made of more than one layer of dissimilar foam plastic material have heretofore been provided. There are no known portable cushions that combine features of both open cell and closed cell foam plastic materials secured to one another at contacting faces to provide user comfort and massage therapy capabilities in both wet and dry situations.

Clarke U.S. Pat. No. 4,457,032 discloses a portable seat cushion consisting of seat and back panels which are hingedly connected to form a unitary structure, the bottom layers of which are of a flexible plastic foam.

Grams U.S. Pat. No. 3,602,548 and Underell U.S. Pat. No. 5,265,292 teach foldable chair and lounge cushions of multiple sections connected by hinges and having strap means for transporting the folded units or securing the cushions in position.

Kaplan U.S. Pat. No. 3,258,791 discloses a mattress pad of a convoluted foam structure. Sarkozi U.S. Pat. No. 5,388,295 pertains to a seat and back support pad of a plurality of rib-like units separated by stitched hinges.

The patents to McMillan U.S. Pat. No. 2,920,619 and Brown, Jr. U.S. Pat. No. 3,841,320 teach vibrators in cushions for user body massage purposes.

Sarno U.S. Pat. No. 4,037,591 illustrates a unitary bath tub pad consisting of multiple foamed sections which are separated from one another, i.e., interconnected, by heat sealing a vinyl casing.

DISCLOSURE OF THE INVENTION

In accordance with the present invention there is provided a portable cushion using layers of different foam plastic materials secured together which has the option of using a vibrator to serve as a therapeutic appliance. One cushion disclosed includes first and second hinged cushion panels that may pivot substantially 360 degrees relative to one another. The first panel has a closed-cell plastic material layer that is impervious to water and the second panel has an open-cell foam plastic layer that will absorb water. Each panel is are adapted to accommodate a vibrator with the vibrations being transmitted through the material for uniform distribution of forces to provide massage therapy. The cushion disclosed is suitable for use in water as in a bathtub to provide user comfort and also the vibrated cushion affords massage therapy that can be advantageous for persons afflicted with blood circulation problems, strained muscles, etc.

BRIEF DESCRIPTION OF THE DRAWINGS

Details of this invention are described in connection with the accompanying drawings which like parts bear similar reference numerals in which:

FIG. 9 is an enlarged perspective view showing the egg crate shaped undulating protuberances in the open cell layer used in the panels shown in FIGS. 1 through 8 for panel 13 with layer 24 removed.

FIG. 10 to a perspective view showing the cushion in a folded-up position under the arm of a user.

FIG. 11 is an end elevational view showing the cushion of FIGS. 1 through 10 in a rolled-up position.

FIG. 12 is a perspective view in an alternative embodiment of the present invention showing a cushion particularly suited for wet applications with a portion of a bathtub shown in dashed lines.

FIG. 13 is a sectional view taken along line 13—13 of FIG. 12.

FIG. 14 is an enlarged sectional view of the embodiment of FIGS. 12 and 13 showing the hinge and a portion of the cushion panels in one folded-up position.

DETAILED DESCRIPTION

Figure 1:
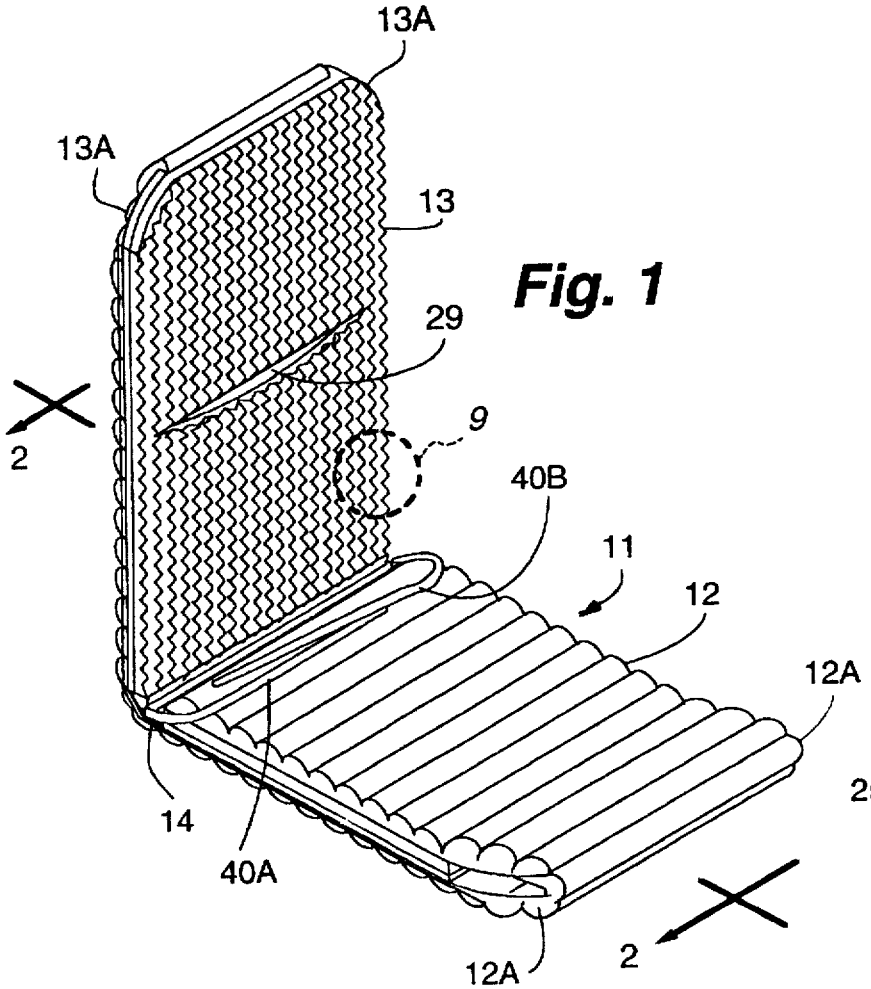
FIG. 1 is a perspective view of a portable cushion particularly suited for use in dry situations such as a chair or auto seat or on a flat surface embodying features of the present invention.
Figure 2:
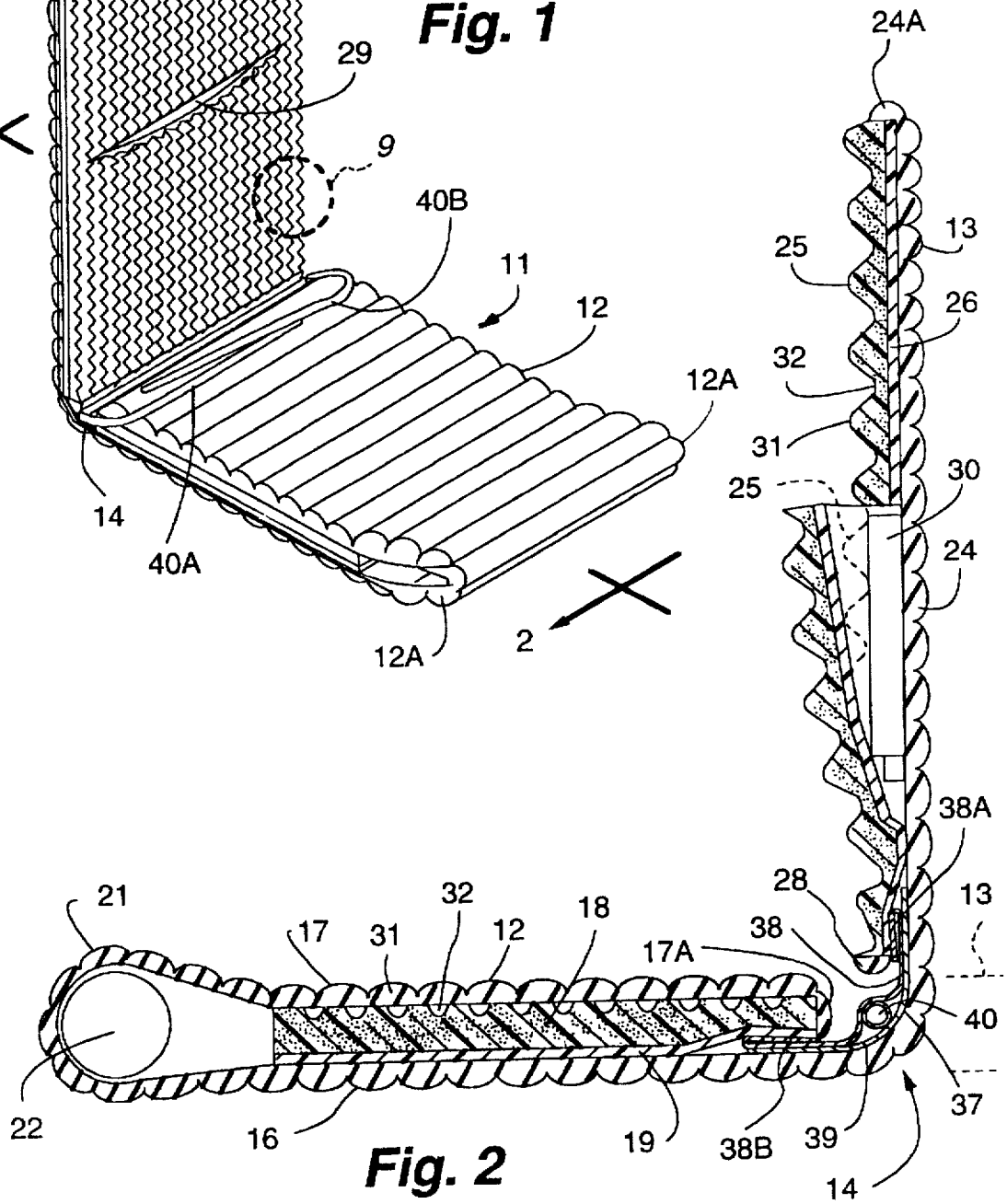
FIG. 2 is a sectional view taken along line 2—2 of FIG. 1 with the two panels in a right angle position relative to one another.
Figure 3:
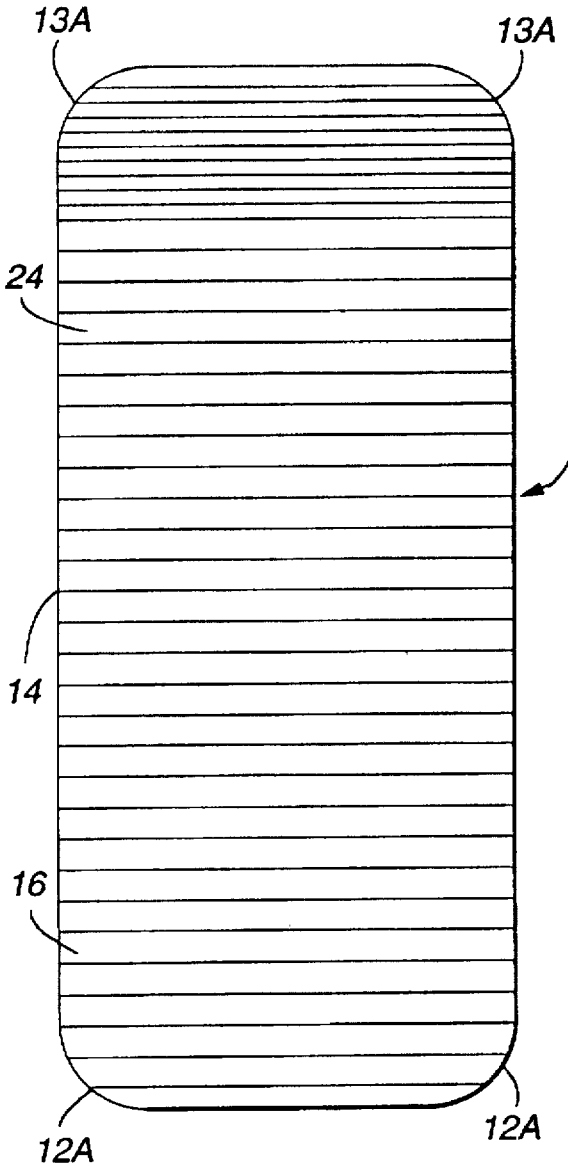
FIG. 3 is a bottom plan view of the cushion shown in FIG. 1 in a flat condition.
Figure 4:
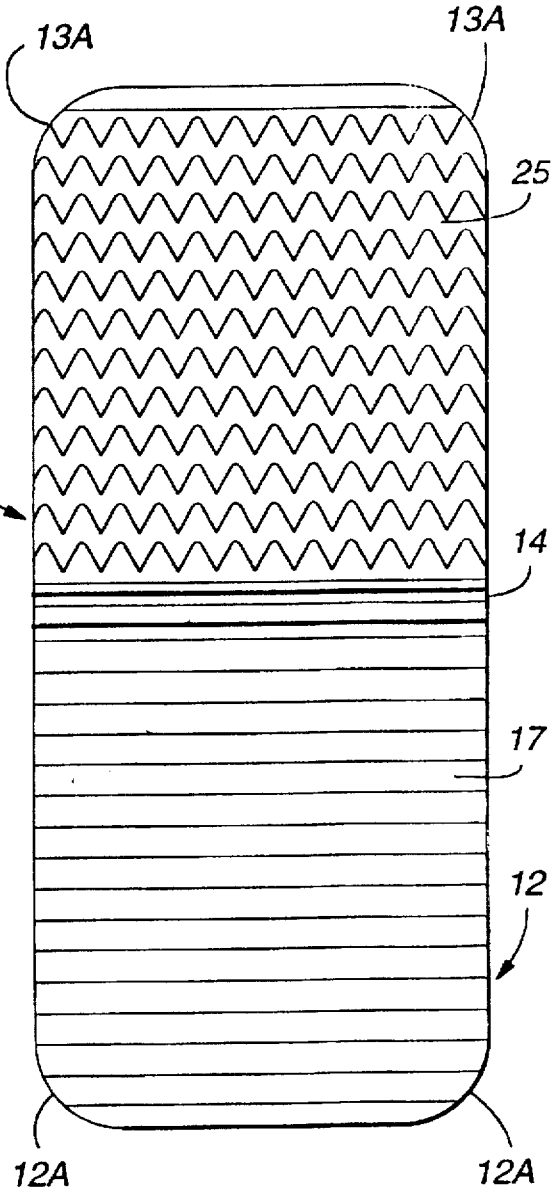
FIG. 4 is a top plan view of the opposite side of the cushion shown in FIG. 1 in a flat condition.
Figure 5:
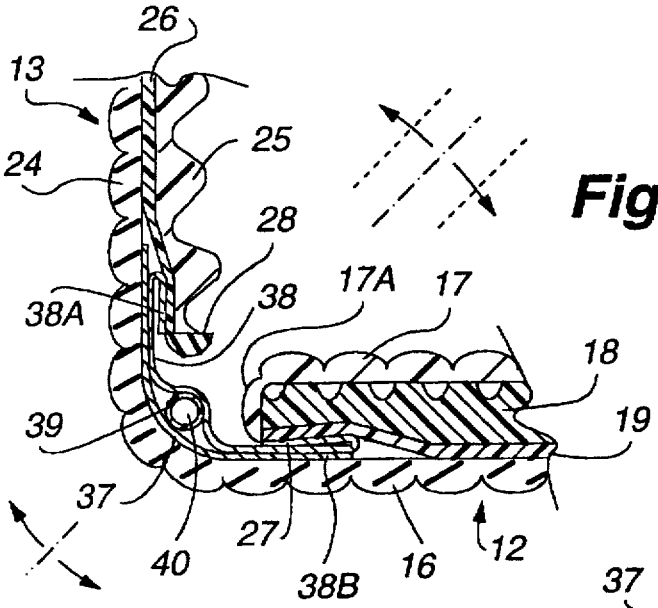
FIG. 5 is an enlarged sectional view showing the hinge with the cushion panels in a right angle position relative to one another.
Figure 6:
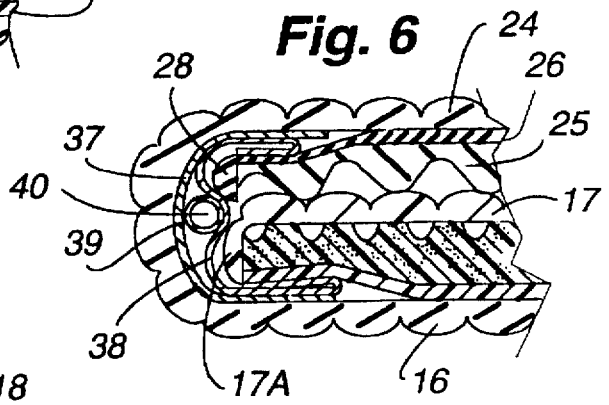
FIG. 6 is an enlarged sectional view showing the hinge and panels folded in one folded-up position.
Figure 7:
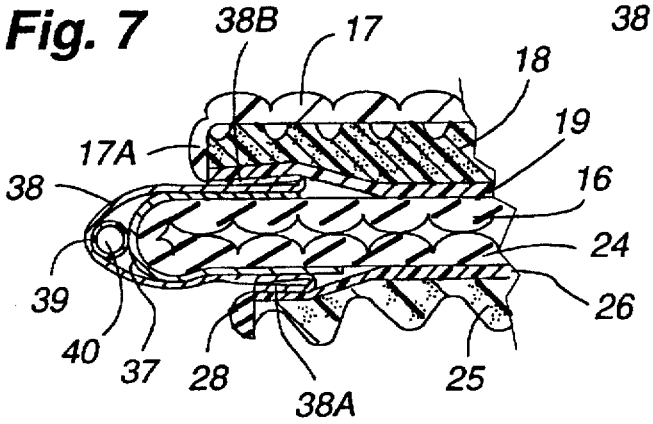
FIG. 7 is an enlarged sectional view showing the hinge and panels folded up in the opposite folded-up position.

Referring now to FIGS. 1–4 there is shown a portable cushion 11 that is particularly suited for use in dry situations such as on auto seats, chairs with backs at right angles to the seat and also on a variety of flat surfaces. This cushion 11 comprises a first panel 12 and a second panel 13 hingedly connected for relative pivotal movement by a hinge 14. The first panel 12 is particularly suited for use as the bottom panel and the second as the back panel when used at right angles to one another as on a chair, auto seat, or the like as shown in FIGS. 1 and 2. The cushion will lay flat when placed on flat surfaces as shown in FIGS. 3 and 4 in which case the panels 12 and 13 are arranged end to end.

The first panel 12 is of a generally rectangular shape and preferably has two rounded corners 12A at the free or outer end. The first panel 12 is shown to be comprised of a first layer 16 of closed cell foam plastic material that is impervious to water and a second layer 17 of the same material with a third layer 18 sandwiched between layers 16 and 17 with abutting or contacting faces of the layers being suitably secured together at contacting faces. Layer 18 is principally made of open cell foam plastic material capable of absorbing water. The third layer 18 has a fourth layer 19 of closed cell foam plastic material secured along one face of layer 18 and secured to one face of layer 16. Fourth layer 19 provides strength to the third layer 18. The end portion of layer 17 is shown at 17A as being folded back against one end of layers 18 and 19 and is secured at contacting faces. The first and second layers 16 and 17 as shown are made of a continuous single unitary piece of the same material that is folded back on itself to form an end loop section 21. The inside of this open-ended loop section 21 serves as an open-ended tubular receptacle that is suitable for receiving a vibrator 22 so that one seated on the cushion can have vibrations imparted through the end loop section 21 and into the body of the user for massage therapy purposes.

The second panel 13 is also of a generally rectangular shape and has two rounded corners 13A at the free or outer end. The second panel 13 has a first layer 24 made of a closed cell foam plastic material impervious to water which in the construction shown has layers 16 and 24 made of continuous unitary piece of the same material. The second panel 13 has a second layer 25 secured at contacting faces to the first layer 24. The second layer is primarily made of open cell foam plastic material capable of absorbing water. As with first panel 12 the second layer 13 is provided with a third layer 26 of closed cell material provides strength for second layer 25. The second panel has a transverse slit 29 in layer 25 opening into a pocket suitable for receiving and containing a vibrator 30. The slit 29 is shown in an open position to receive the vibrator and will return to a flat co-planar relative to the rest of the layer 25 as shown in dashed lines. This pocket is suitable for storing a variety of articles useful to the user. The end portion of layer 24 is shown at 24A as wrapped or folded around the end of layers 25 and 26 and secured thereto. A semi-circular end segment 28 of the same closed cell material as the first or second layers is secured to the end of layers 25 and 26 opposite folded end portion 24A and adjacent the hinge described hereafter.

Figure 8:
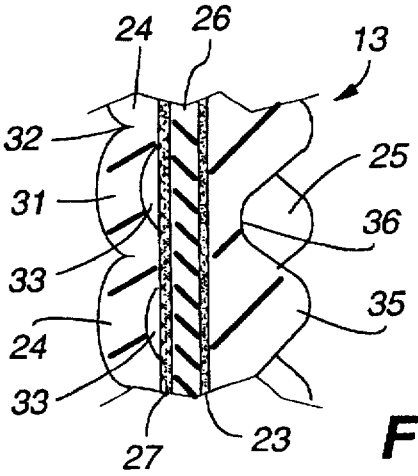
FIG. 8 is an enlarged sectional view showing the detail of the second panel shown in FIGS. 1 through 7.

Referring now to FIG. 8 there is shown for second panel 13 an adhesive layer 23 between a face of layer 25 and one face of layer 26 and an adhesive layer 27 between a face of layer 26 and the other face of layer 24. Contact cement has been found particularly suitable for securing all faces between abutting faces of the layers described herein. It is understood the other securing means may be provided such as using pellets and heating and fusing. Laser welding may also be used to secure the contacting faces or surfaces.

The closed cell material of layer 24 shown particularly in FIG. 8 has a convoluted profile with a series of alternating peaks 31 and valleys 32. Opposite the peak there is a slight concavity 33 in the opposite surface. When the material is in contact with a supporting surface this layer affords a high degree of friction. This is due to the resistance of the material surface and also due to the pockets of air formed by the valleys when the surface is in contact with an adjacent supporting surface. This high degree of friction avoids slippage on the seat or slippage in a bathtub or the like. When in a flat or planar condition as shown in FIGS. 3 and 4 the outer first layers 16 and 24 of the two panels usually rest on the supporting surface.

The open cell material of layer 25 shown particularly in FIG. 8 has an outer face with undulating protuberances arranged as a series of alternating apexes 35 and cavities 36. This may also be characterized as egg crate shaped. The open cell material of layer 25 absorbs water and provides a very cushioned or soft effect for the user in contrast to sitting on or leaning against a hard surface such as that found in the bathtub.

The hinge 14 shown includes an inner strip 37 and an outer strip 38 with the inner strip 37 secured along the inside of the first layers 16 and 24 at the bend dividing the two panels 12 and 13. The outer strip 38 is secured to the inner strip 35. A backfolded end section 38A providing a double thickness extends under layer 19 and is secured thereto. Strip 38 has a backfolded section 38B providing a double thickness that extends under layer 19 and is secured thereto. Each strip 37 and 38 is a flexible fabric preferably a thin plastic vinyl material. A flexible tube 39 of an elastomeric or rubber extends through a space between the two strips with the ends of the tube coextensive with the edges of the panels. A flexible cord 40 such as a bungee type cord extends through the tube 39 and has end extensions 40A and 40B that can be used to tie the cushion to a wall support or the like for drying purposes. These extensions fold back to be inside the panels as shown.

The cushion 11 may be rolled into a circular package as is shown in FIG. 11. The rolling can be done beginning at either end of the cushion and makes a tight package that is easily carried under the arm or in one hand.

While the user of two panels connected by a hinge as above described is preferred for most applications, it is understood that one panel like panel 13 with one layer 16 of the open cell foam plastic material and the opposite layer 24 of closed cell material secured along abutting faces may be used for some applications within the scope of the present invention.

Referring now to FIGS. 12 and 13 there is shown another embodiment of a portable cushion 41 more particularly suited for use in water having a first panel 42 and a second panel 43 hingedly connected for relative pivotal movement by a hinge 44.

The first panel 42 has a first layer 46 of open cell foam plastic material and a second layer 47 of the same material. First layer 46 has a closed cell layer 48 secured thereto and second layer 47 has a closed cell layer 49 secured thereto for added strength. The first layer 46 is folded back on itself to form a loop section 50 adapted to receive a vibrator. The inside of this open-ended loop section serves as an open-ended tubular receptacle. A third layer 51 of closed cell material is sandwiched between layers 46 and 47 and is secured specifically to layers 47 and 48. An end section 52 of closed cell material is secured at one end of layers 47 and 49. An end section 53 of closed cell material is secured to the ends of layers 57 and 58.

The second panel 43 has a first layer 56 of closed cell material and a second layer 57 of open cell material similar to layers 26 and 25 of panel 13 above described. Layer 57 has a closed cell backing layer 58. Layers 51 and 56 are made of a continuous unitary piece of the same closed cell material.

The hinge 44 has a flexible tube 59 with a flexible cord 60 having flexible extensions 60A and 60B provided similar to hinge 14 and tube 39 and cord 40 above described so that a description of one applies to both. The cushion 42 is shown in FIG. 12 as disposed in a bathtub B. In the folded-down position shown in FIG. 14 the protuberances of layers 47 and 57 interweave or interlock with one another.

In the wet applications the open cell material absorbs the water and the user's body pressing against the water filled material pumps water against the body. The closed cell material will tend to float on the water.

In both applications both the open cell and closed cell materials exhibit a high degree of friction so the material does not tend to slip on the supporting surface.

A closed cell foam plastic material that has been found particularly suitable is a thermal formed polyethylene foam product sold by Foam Designer Consumer products Inc., Lexington, Ky., under the trademark Roll-eez. This material is very flexible and durable.

An open cell foam plastic material that has been found particularly suitable is a polyethylene foam referred to as convoluted foam polyethylene backing adhesively secured on the back that is a closed cell foam for forming a moisture barrier. This material is soft and durable. This is sold under the trademark SIERRA by the above mentioned company.

Although the present invention has been described with a certain degree of particularity, it is understood that the present disclosure has been made by way of example and that changes in details of structure may be made without departing from the spirit thereof.

What is claimed is:

1. A portable flexible cushion for user body comfort and user body stimulation suitable for both wet and dry use comprising:

first and second panels connected by a hinge for relative pivotal movement, each of said panels having a first layer of closed cell foam plastic material impervious to a liquid so as to float in the liquid, said layer of closed cell foam plastic material being a continuous unitary piece for both of said first and second panels, said hinge including a strip of flexible material secured along one face intermediate the ends of said continuous unitary piece of closed cell plastic material and at least one of said panels having a second layer of open cell foam plastic material capable of absorbing a liquid and releasing a liquid in response to a surface pressure applied thereto, said second layer being superposed on and secured to said first layer of one of said panels at adjacent faces a pocket formed between said layer of open cell foam plastic material and said closed cell foam plastic material of said one panel, said pocket having an access opening.

2. A cushion as set forth in claim 1 wherein said first and second panels are disposed at right angles for use as a seat cushion and in the substantially same plane for use as a flat mat with a range of relative angular positions so that either of said panels may pivot substantially 360 degrees relative to the other so as to be reversible.

3. A cushion as set forth in claim 1 wherein said second layer of open cell foam plastic material is secured to said first layer of one of said panels by contact cement.

4. A cushion as set forth in claim 1 wherein said layer of closed cell foam plastic material has a surface with a convoluted profile with a series of alternating peaks and valleys.

5. A cushion as set forth in claim 4 wherein said peaks are curved and said valleys are substantially V-shaped.

6. A cushion as set forth in claim 1 wherein said hinge includes a pair of flexible hinge strips, each made of fabric said hinge strips being secured along inside adjacent contacting faces of said first and second panels.

7. A cushion as set forth in claim 6 wherein said fabric is a plastic vinyl and each hinge strip is of a rectangular shape.

8. A cushion as set forth in claim 6 wherein each of said panels has an end section of closed cell form plastic material secured at an inner end adjacent said hinge section.

9. A cushion as set forth in claim 1 wherein said layer of open cell foam plastic material has a surface with egg crate shaped undulating protuberances arranged as a series of alternating apexes and cavities.

10. A cushion as set forth in claim 9 wherein said apexes and cavities are of a sinuous shape.

11. A cushion as set forth in claim 1 wherein said layer of open cell plastic material has a backing layer of closed cell plastic material for added strength.

12. A cushion as set forth in claim 1 wherein at least one of said panels is adapted to respond to an adjacent vibrator carried by said panel to transmit vibrations via an associated layer to the user.

13. A cushion as set forth in claim 1 wherein one of said panels has a slit opening into an interior pocket formed in said one panel to provide said access opening for article storage purposes.

14. A cushion as set forth in claim 13 wherein said pocket is arranged for containing a vibrator to transmit vibrations via an associated layer to the user.

15. A cushion as set forth in claim 1 wherein said first panel includes and additional layers of a closed cell plastic material and a layer of open cell plastic material sandwiched between and secured to said of close cell plastic material.

16. A cushion as set forth in claim 1 wherein said panels are capable of being folded back on one another for carriage under the arm and capable of being rolled into a tight spiral package for carriage.

17. A portable flexible cushion for body comfort and stimulation particularly suitable for dry situations comprising:

first and second cushion panels connected by a hinge for pivotal movement so that either of said panels may pivot substantially 360 degrees relative to the other so as to be reversible and fold back against one another to a folded-up position and be set at any angular position, said first panel having first and second layers of a closed-cell foam plastic material, said first and second layers being a continuous single piece of material that is folded back on itself forming a looped end section adapted to receive a vibrator to transmit vibrations via an associated layer to the user and a third layer including an open cell foam plastic material secured between said first and second layers, said second panel having a layer that is an extension of said second outer layer and a layer of open cell foam plastic material, said hinge including a pair of flexible hinge strips secured along the inside to said first and second panels and a flexible tube sandwiched at an intermediate position between said hinge strips, a flexible cord extending through said tube having extensions beyond said tube for tying said panels to a support.

18. A portable flexible cushion for body comfort and stimulation particularly suitable for wet situations comprising:

first and second cushion panels connected by a hinge for pivotal movement so that either of said panels may pivot substantially 360 degrees relative to the other so as to be reversible and fold back against one another to a folded-up position and be set at any angular position, said first panel having first and second layers of an open cell foam plastic material, said first and second layers being a continuous single piece of material that is folded back on itself forming a looped end section adapted to receive a vibrator to transmit vibrations via an associated layer to the user and a third layer including a closed-cell foam plastic material secured between said first and second layers, said second panel having a layer that is an extension of said third layer and a layer of open cell foam plastic material, said hinge including a pair of flexible hinge strips secured along the inside to said first and second panels and a flexible tube sandwiched at an intermediate position between said hinge strips, a flexible cord extending through said tube having extensions beyond said tube for tying said panels to a support.

19. A portable flexible cushion for user body comfort and user body stimulation suitable for both wet and dry use comprising:

first and second panels connected by a hinge for relative pivotal movement, each of said panels having a layer of closed cell foam plastic material impervious to a liquid so as to float in the liquid, and at least one of said panels having a layer of open cell foam plastic material capable of absorbing a liquid and releasing a liquid in response to a surface pressure applied thereto, said second layer being superposed on and secured to said first layer of one of said panels at adjacent faces, said hinge including a pair of flexible hinge strips, said hinge strips being secured along inside adjacent contacting faces of said first and second panels, one of said hinge strips having a folded back end section to provide a double thickness.

20. A cushion as set forth in claim 19 including a flexible tube extending between said hinge strips, secured thereto and coextensive with the width of said panels and a flexible cord extending through said hinge strip and having extensions beyond said tube for tying said panels to a support.

21. A cushion as set forth in claim 20 wherein said flexible cord is a bungee type cord.

22. A portable flexible cushion for user body comfort and user body stimulation suitable for both wet and dry use comprising:

first and second panels connected by a hinge for relative pivotal movement, each of said panels having a layer of closed cell foam plastic material impervious to a liquid so as to float in the liquid, and at least one of said panels having a layer of open cell foam plastic material capable of absorbing a liquid and releasing a liquid in response to a surface pressure applied thereto, said second layer being superposed on and secured to said first layer of one of said panels at adjacent faces, said first panel having first and second layers made of a continuous single piece folded back on itself to form an open-ended looped end section adapted to receive a vibrator to transmit vibrations via an associated layer to the user.

23. A cushion as set forth in claim 22 wherein said single piece is made of a closed cell foam plastic material.

24. A cushion as set forth in claim 22 wherein said single piece is made of an open cell foam plastic material.

* * * * *